United States Patent [19]

Fukuoka et al.

[11] Patent Number: 4,828,657

[45] Date of Patent: May 9, 1989

[54] METHOD FOR PRODUCTION OF TIN-COBALT, TIN-NICKEL, OR TIN-LEAD BINARY ALLOY ELECTROPLATING BATH AND ELECTROPLATING BATH PRODUCED THEREBY

[75] Inventors: Kazuhiro Fukuoka, Matsudo; Haruo Konishi, Tokyo, both of Japan

[73] Assignee: Kosaku & Co., Ltd., Tokyo, Japan

[21] Appl. No.: 200,723

[22] Filed: May 31, 1988

[30] Foreign Application Priority Data

Dec. 5, 1987 [JP] Japan ..... 62-306851

[51] Int. Cl.[4] ..... C25D 3/60

[52] U.S. Cl. ..... 204/44.4; 204/44.5

[58] Field of Search ..... 204/44.4, 44.5

[56] References Cited

U.S. PATENT DOCUMENTS 4,617,097 10/1986 Nobel et al. ..... 204/44.4

4,662,999 5/1987 Opaskar et al. ..... 204/44.4

*Primary Examiner*—G. L. Kaplan

*Attorney, Agent, or Firm*—Oblon, Fisher, Spivak, McClelland & Maier

[57] ABSTRACT

An electroplating bath for the formation of a tin-cobalt, tin-nickel, or tin-lead binary alloy coating is produced by mixing (a) as alloy coating-forming agent a tin salt and one member selected from the group consisting of a cobalt salt, a nickel salt, and a lead salt, (b) 1-hydroxyethane-1,1-diphosphoric acid and/or a salt thereof, (c) methanesulfonic acid and/or an alkali salt thereof, and (d) an electroconductive salt. A coating formed by electroplating using the bath is stable and excellent in gloss.

16 Claims, No Drawings

METHOD FOR PRODUCTION OF TIN-COBALT, TIN-NICKEL, OR TIN-LEAD BINARY ALLOY ELECTROPLATING BATH AND ELECTROPLATING BATH PRODUCED THEREBY

BACKGROUND OF THE INVENTION

1. Field of the Invention

This invention relates to a method for production of tin-cobalt, tin-nickel, or tin-lead binary alloy electroplating bath composition and an electroplating bath produced thereby which produces a tin-cobalt, tin-nickel, or tin-lead binary alloy coating glossy and excellent in decorative effect and permits stable plating work.

2. Prior Art Statement

Methods for electrodepositing tin-cobalt, tin-nickel, and tin-lead binary alloy platings have been known in the art.

A method disclosed by T. L. Ramachar "Electrochemistry", 25, 573 (1957), a method disclosed by A. E. Davies and R. M. Angleo "Trans. Inst. Metal Finishing", 33, 277 (1956), and a method disclosed by A. Brenner "Electrodeposition of alloys", vol. 2, 339 (1963) are examples. The coatings electrodeposited in a large thickness by these known methods have a disadvantage that they have no gloss, assume a grayish white color, and sustain cracks under strong stress.

For this reason, these alloy coatings can be used only for thin decorative coatings, though they possess as high corrosion proofness as Monel Metal or Inconel.

As tin-lead alloy electrodepositing baths, a borofluoride bath, a pyrophosphoric acid bath, etc. are available. These methods have problems relating to the safety of workers and are apt to cause water pollution. Moreover, the bath compositions are susceptible to degeneration due to oxidation because they use divalent tin.

The inventors continued a study with a view to developing a plating method which is free form the drawbacks of such conventional methods as described above and is capable of producing a glossy coating without reference to thickness. So far they have secured Japanese Patent No. 1,027,262 for an invention characterized by containing 1-hydroxyethane-1,1-phosporic ester or a salt thereof in a plating bath, Japanese Patent No. 1,027,292 for an invention characterized by further containing aldehyde and a betaine compound, and Japanese Patent No. 1,166,434 and No. 1,180,236 for an invention characterized by containing glycol ether.

OBJECT AND SUMMARY OF THE INVENTION

Coatings of tin-cobalt, tin-nickel, and tin-lead alloys are used in various kinds of articles. In recent years, a need has arisen for a coating of rich gloss and high decorative value. As a result, there is a need for a plating bath capable of stably forming a coating of desired composition.

Through various studies the inventors discovered that a plating bath incorporating therein a mixture of 1-hydroxyethane-1,1-diphosphoric acid or a salt thereof with methanesulfonic acid or an alkali salt therof permits a notable addition to the decorative valve of a coating and that a bath using a stannic salt thereof permits the plating work to be performed stably and easily. The present invention has been perfected on the basis of this knowledge.

To be specific, this invention is directed to a method for the production of a tin-cobalt, tin-nickel, or tin-lead binary alloy electroplating bath composition, characterized by mixing (a) a tin salt and at least one member selected from the group consisting of a cobalt salt, a nickel salt, and a lead salt as alloy coating-forming agents, (b) at least one member selected from the group consisting of 1-hydroxyethane-1,1-diphosphoric acid and salts thereof, (c) at least one member selected from the group consisting of methanesulfonic acid and alkali salts thereof and (d) at least one electroconductive salt, and to a tin-cobalt, tin-nickel, or tin-lead binary alloy electroplating bath composition characterized by containing the components mentioned above and produced by the method described above.

DETAILED DESCRIPTION OF THE PREFERRED EMBODIMENTS

Now, the method of production mentioned above and the components used in the production of the bath will be described below.

(a) This component comprises alloy coating-forming agents which are required to account for specific concentrations, i.e. the tin salt 5 to 50 g/liter, the cobalt salt 3 to 12 g/liter, the nickel salt 3 to 13 g/liter, and the lead salt 3 to 25 g/liter respectively as metal. If the concentration of this component is higher than the range mentioned above, the components of (b) and (c) are not sufficient in supply for the plating bath to manifest its function satisfactorily. If the concentration is lower than the range, the plating bath forms the coating slowly and impairs the alloy ratio necessary for manifestation of high corrosionproofness and consequently fails to fulfil the object of plating.

(b) This component is represented by the following general formula and contributes to greatly enhancing the gloss of the coating.

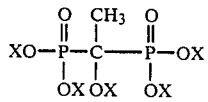

wherein X stands for hydrogen, sodium, potassium, calcium, magnesium, or ammonia. The amount of this component to be added is in the range of 80 to 140 g/liter. If the concentration of this component is larger than the range mentioned above, the bath concentration becomes unduly large. If the concentration is lower than the range, the effect of the addition of this component is lost.

(c) The addition of this component constitutes an important feature of this invention. It enables the produced coating to acquire an exceptionally beautiful decorative appearance. The amount of this component to be added is desired to fall in the range of 1 to 4 mols per mol of 1-hydroxyethane-1,1-diphosphoric acid or salt thereof. The total amount of the components (b) and (c) in the bath must be in the range of 40 to 180 g per liter. For use in the alloy coating-forming agent, the tin salt is desired to be a tetravalent compound such as sodium stannate, potassium stannate, or a chloride, the cobalt and nickel salts are each desired to be a chloride, sulfate, or perchlorate, and the lead salt is desired to be a water-soluble compound such as an acetate or perchlorate.

Owing to the use of a stannic (tetravalent) salt as the tin salt, the plating bath of this invention prevents otherwise possible change of the tin concentration therein due to oxidation and enables the component metals of the plating alloy, namely tin-cobalt, tin-nickel, or tin-lead, placed therein to be simultaneously chelated so that the ratio of metal concentrations in the bath coincides with that in the alloy coating to be formed by plating.

The composition of the alloy coating formed by electrodeposition, therefore, can be easily managed by maintaining the ratio of metal concentrations in the bath within a fixed range.

(d) The plating bath of this invention naturally contains such a known electroconductive salt as sodium chloride, potassium chloride, potassium sulfate, sodium sulfate, or ammonium sulfate which is indispensable to the operation of electrodeposition. The amount of this electroconductive salt to be added is in the generally accepted range of 15 to 80 g/liter. If the amount of this salt is unduly large, the excess salt can cause coating defects such as surface streaks. If the amount is unduly small, the bath has high electric resistance.

The bath composition of the present invention is produced by mixing the aforementioned four components (a), (b), (c) and (d). The coating produced by the electroplating using this bath composition possesses heretofore unattainable excellent metallic gloss.

The electroplating bath of the present invention, when necessary, may incorporate other components therein to the extent extent that the bath composition is not adversely affected by the added components.

The plating operation using the electroplating bath of this invention is desired to be carried out under conditions such that the bath temperature falls in the range of 50° to 65°C., the current density at the cathode in the range of 0.5 to 5 A/dm$^2$, and the current density at the anode in the range of 0.5 to 2.5 A/dm$^2$. The pH value of the plating bath can be selected within a very wide range of 3 to 13.5.

The anode may be an ordinary insoluble anode of carbon or ferrite. A variable anode may be also used. When the plating bath is acidic, for example, an anode made of the same substance as the coating-forming substance, i.e. tin, cobalt, or nickel may be used. Where a tin alloy coating is to be formed, for example, the plating is effected by using an anode made of tin, partitioning the interior of the bath with a cation-exchange membrane, allowing stannous ion dissolving out of the anode to be oxidized into stannic ion, and passing the stannic ion through a diaphragm into the bath. In this case, since the tin is supplied from the anode, the coating-forming substance to be replenished with the progress of the plating operation may be limited to the other member of the coating-forming agent than the tin salt. Thus, the control of both compositions is very easy.

Now, the present invention will be described below with reference to working examples and comparative experiments.

EXAMPLES 1 to 28 and COMPARATIVE EXPERIMENTS 1 to 11

Various bath compositions according with this invention were prepared with the components indicated in Table 1 and they were used for plating under the conditions shown in Table 2. The properties shown by the coatings consequently formed were as shown in Table 2.

Various bath compositions for comparison were prepared with the components indicated in Table 3. The properties shown by the coatings formed using the bath compositions were as shown in Table 2. In the bracket (b)(c) of Table 1, P stands for 1-hydroxyethane-1,1-diphosphoric acid, PN for sodium salt thereof, H for methanesulfonic acid, and HN for sodium salt thereof, and numerals molar ratio.

The time of electrolysis was 2 to 4 minutes for the plating with the tin-cobalt alloy or with the tin-nickel alloy and 5 to 10 minutes for the plating with the tin-lead alloy. The adhesion test was carried out in accordance with the method of JIS H8504, 3-8-a, with the results rated on a three-point scale, wherein O stands for absence of separation, Δ for 5% separation, an x for 10% separation. The results of the test for resistance to nitric acid, the test for resistance to hydrochloric acid, and the test for resistance to an alkali etchant were rated on a three-point scale, wherein O stands for absence of change, Δ for slight change, and x for appreciable change respectively in alloy coating after immersion. The results of the test for gloss were rated on a three-point scale, wherein ⊖ stands for conspicuous gloss O for ordinary gloss, and ⓧ for rather poor gloss.

TABLE 1

| Composition (g/l) | | Example No. 1 | 2 | 3 | 4 | 5 | 6 | 7 | 8 |
|---|---|---|---|---|---|---|---|---|---|
| (a) Component | $Na_2[Sn(OH)_6]$ | 90 | | | | 80 | | | |
| | $K_2[Sn(OH)_6]$ | | 100 | | | | 95 | | |
| | $Sn(SO_4)_2.2H_2O$ | | | 50 | | | | 50 | 50 |
| | $SnCl_4.5H_2O$ | | | | 50 | | | | |
| | (Sn) | 40 | 40 | 17 | 17 | 36 | 38 | 17 | 17 |
| | $CoCl_2.6H_2O$ | 40 | 40 | 17 | 17 | | | | |
| | $CoSO_4.7H_2O$ | | | 15 | 15 | | | | |
| | (Co) | 10 | 10 | 3 | 3 | | | | |
| | $NiCl_2.6H_2O$ | | | | | 24 | | 20 | |
| | $NiSO_4.6H_2O$ | | | | | | 31 | | 18 |
| | (Ni) | | | | | 6 | 7 | 5 | 4 |
| (b)(c) component | | 120 IPN2H | 110 IPN4H | 80 IPN1H | 80 IPN1HN | 160 IPN4HN | 100 IP3H | 90 IP1H | 70 IPN1HN |
| Electroconductive salt (d) | | NaCl | KCl | $(NH_4)_2SO_4$ | $NH_4Cl$ | $K_2SO_4$ | $Na_2SO_4$ | KCl | $NH_4Cl$ |
| Amount added | | 20 | 30 | 40 | 50 | 15 | 15 | 30 | 50 |

TABLE 2

| Composition (g/1) | | Example No. 9 | 10 | 11 | 12 | 13 | 14 | 15 | 16 | 17 | 18 |
|---|---|---|---|---|---|---|---|---|---|---|---|
| (a) com- | $Na_2[Sn(OH)_6]$ | | | 30 | | 80 | | | | | |

TABLE 2-continued

| | | | | | | | | | | | |
|---|---|---|---|---|---|---|---|---|---|---|---|
| ponent | $K_2[Sn(OH)_6]$ | | | 35 | 120 | | | 80 | | | |
| | $Sn(SO_4)_2.2H_2O$ | | 20 | | | | | 50 | | | 45 |
| | $SnCl_4.5H_2O$ | 65 | | | | | | | 30 | | |
| | (Sn) | 22 | 7 | 13 | 14 | 36 | 48 | 17 | 10 | 32 | 15 |
| | $CoCl_2.6H_2O$ | | | | | | | 15 | 16 | 30 | |
| | $CoSO_4.7H_2O$ | | | | | 16 | 45 | | | | 33 |
| | Co) | | | | | 3 | 9 | 4 | 4 | 7 | 7 |
| | $Pb(CH_3COO)_4$ | | 10 | | 10 | | | | | | |
| | $Pb(CH_3COO)_2.3H_2O$ | 12 | | | | | | | | | |
| | $PbHC_6N_5O_7.H_2O$ | | | 15 | | | | | | | |
| | (Pb) | 7 | 5 | 8 | 5 | | | | | | |
| | (b)(c) component | 80 | 70 | 65 | 60 | 100 | 100 | 90 | 70 | 120 | 75 |
| | Electroconductive salt (d) | IP1H NHC4l | IP3H $(NH_4)_2SO$ | IPN1H KCl | IPN4HN $K_2SO_4$ | IPK2H $K_2SO_4$ | IP1H NaCl | IPN2H $Na_2SO_4$ | IP1H $NH_4Cl$ | IP3H KCl | IPN4HN $NH_4Cl$ |
| | Amount added | 30 | 20 | 30 | 25 | 20 | 15 | 15 | 50 | 30 | 60 |

| | Composition (g/l) | Example No. 19 | 20 | 21 | 22 | 23 | 24 | 25 | 26 | 27 | 28 |
|---|---|---|---|---|---|---|---|---|---|---|---|
| (a) component | $Na_2[Sn(OH)_6]$ | 75 | | 35 | | | 25 | | | | |
| | $K_2[Sn(OH)_6]$ | | | | | | | | 50 | | 60 |
| | $Sn(SO_4)_2.2H_2O$ | | | | 90 | 70 | | 45 | | 40 | |
| | $SnCl_4.5H_2O$ | | 40 | | | | | | | | |
| | (Sn) | 33 | 14 | 16 | 30 | 24 | 11 | 15 | 20 | 14 | 24 |
| | $CoCl_2.6H_2O$ | | 18 | | | | | | | | |
| | $CoSO_4.7H_2O$ | 30 | | | | | | | | | |
| | (Co) | 7 | 4 | | | | | | | | |
| | $Pb(CH_3COO)_2.3H_2O$ | | | 20 | 16 | | | | 30 | | |
| | $Pb(CH_3COO)_4$ | | | | | | 15 | 10 | | | |
| | $PbHC_6N_5O_7.H_2O$ | | | | | 15 | | | | 10 | 40 |
| | (Pb) | | | 12 | 10 | 8 | 8 | 5 | 18 | 5 | 21 |
| | (b)(c) component | 140 | 75 | 80 | 75 | 90 | | 70 | 100 | 50 | 110 |
| | Electroconductive salt (d) | IPN2H $K_2SO_4$ | IPN1HN $NH_4Cl$ | IPN2H NaCl | IPN1H $NH_4Cl$ | IPN4H $NH_4Cl$ | IPN2H NaCl | IPN1H $(NH_4)_2SO_4$ | IPN2H NaCl | IP3H $(NH_4)_2SO_4$ | IPN2H KCl |
| | Amount added | 20 | 50 | 25 | 65 | 65 | 30 | 70 | 40 | 70 | 50 |

TABLE 3

| | Example No. | | | | | | | | | | | | | | |
|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 |
| pH | 13 | 12.0 | 3.5 | 3.5 | 13 | 12 | 4 | 4 | 4 | 4 | 13 | 12 | 13 | 12 | 3.5 |
| Current density at cathode, A/dm$^2$ | 0.5~2 | 0.5~2 | 1.0~3.0 | 1.0~3.0 | 0.5~2 | 0.5~2 | 1.0~3.0 | 1.0~3.0 | 1.0~4 | 1.0~4 | 0.5~5 | 0.5~5 | 0.5~2 | 0.5~2 | 1.0~3.0 |
| Current density at anode, A/dm$^2$ | 0.5~1 | 0.5~1 | 0.5~1.5 | 0.5~1.5 | 0.5~1 | 0.5~1.5 | 0.5~1.5 | 1.8~1.5 | 0.5~2 | 0.5~2.5 | 0.5~2.5 | 0.5~2.5 | 0.5~1 | 0.5~1 | 0.5~1.5 |
| Bath temperature (°C.) | 55~60 | 55~60 | 50~55 | 50~55 | 55~60 | 55~60 | 50~55 | 55~60 | 50~60 | 50~60 | 50~60 | 50~60 | 55~60 | 55~60 | 50~60 |
| Anode | carbon | carbon | tin | tin | ferrite | carbon | tin | tin | tin | tin | 18-8 stainless steel | carbon | carbon | carbon | 18-8 stainless steel |
| Anion-exchange membrane | x | x | ○ | ○ | x | x | ○ | ○ | ○ | ○ | x | x | x | x | x |
| Stirring | x | x | airation | airation | x | x | airation | airation | airation | airation | x | x | x | x | x |
| Undercoating | nickel | nickel | nickel | nickel | nickel | nickel | nickel | nickel | copper | copper | copper | copper | nickel | nickel | nickel |
| Tin content in deposited coating (% by weight) | 80.7 | 81.1 | 81.9 | 80.6 | 66.6 | 65.7 | 64.7 | 65.5 | 90.2 | 60.2 | 61.0 | 60.4 | 82.1 | 81.2 | 82.2 |
| Resistance to nitric acid | ○ | ○ | ○ | ○ | ○ | ○ | ○ | ○ | x | x | x | x | ○ | ○ | ○ |
| Resistance to hydrochloric acid | x | x | x | x | ○ | ○ | ○ | ○ | ○ | ○ | ○ | ○ | x | x | x |
| Resistance to alkali etchant | ○ | ○ | ○ | ○ | ○ | ○ | ○ | ○ | ○ | ○ | ○ | ○ | ○ | ○ | ○ |
| Adhesiveness | ○ | ○ | ○ | ○ | ○ | ○ | ○ | ○ | ○ | ○ | ○ | ○ | ○ | ○ | ○ |
| Gloss | ◎ | ◎ | ○ | ◎ | ○ | ◎ | ○ | ◎ | ○ | ○ | ○ | ○ | ○ | ○ | ◎ |

| | Example No. | | | | | | | | | | | | |
|---|---|---|---|---|---|---|---|---|---|---|---|---|---|
| | 16 | 17 | 18 | 19 | 20 | 21 | 22 | 23 | 24 | 25 | 26 | 27 | 28 |
| pH | 4 | 12 | 3.5 | 13.0 | 4 | 13 | 4 | 4 | 13 | 4 | 12 | 4 | 12 |
| Current density at cathode, A/dm$^2$ | 1.0~3.0 | 0.5~2 | 1.0~3.0 | 0.5~2 | 1.0~3.0 | 1.0~5 | 1~4 | 1~4 | 1~5 | 1~4 | 1~5 | 1~4 | 1~5 |
| Current density at anode, A/dm$^2$ | 0.5~1.5 | 0.5~1 | 0.5~1.5 | 0.5~1 | 0.5~1.5 | 0.5~2.5 | 0.5~2 | 0.5~2 | 0.5~2.5 | 0.5~2 | 0.5~2.5 | 0.5~2 | 0.5~2.5 |
| Bath temperature (°C.) | 50~55 | 55~60 | 55~55 | 50~60 | 55~55 | 50~60 | 50~60 | 50~60 | 50~60 | 50~60 | 50~60 | 50~60 | 50~60 |
| Anode | carbon | 18-8 stainless steel | tin | carbon | ferrite | carbon | carbon | tin | 18-8 stainless steel | ferrite | carbon | tin | 18-8 stainless steel |
| Anion-exchange membrane | x | x | ○ | x | x | x | x | ○ | x | x | x | ○ | x |
| Stirring | x | x | airation | x | x | x | x | airation | x | x | x | airation | x |
| Undercoating | nickel | nickel | nickel | nickel | nickel | copper | copper | copper | copper | copper | copper | copper | copper |
| Tin content in deposited coating (% by weight) | 79.7 | 65.8 | 67.4 | 68.1 | 66.0 | 59.7 | 90.5 | 91.0 | 62.0 | 89.8 | 61.2 | 90.9 | 60.0 |
| Resistance to nitric acid | ○ | ○ | ○ | ○ | ○ | x | x | x | x | x | x | x | x |
| Resistance to hydrochloric acid | x | ○ | ○ | ○ | ○ | ○ | ○ | ○ | ○ | ○ | ○ | ○ | ○ |
| Resistance to alkali etchant | ○ | ○ | ○ | ○ | ○ | ○ | ○ | ○ | ○ | ○ | ○ | ○ | ○ |
| Adhesiveness | ○ | ○ | ○ | ○ | ○ | ○ | ○ | ○ | ○ | ○ | ○ | ○ | ○ |
| Gloss | ○ | ◎ | ○ | ◎ | ◎ | ○ | ○ | ○ | ○ | ○ | ○ | ○ | ○ |

TABLE 4

| Composition (g/l) | Comparative Experiment No. 1 | 2 | 3 | 4 | 5 | 6 | 7 | 8 |
|---|---|---|---|---|---|---|---|---|
| (a) Component | | | | | | | | |
| $Na_2[Sn(OH)_6]$ | 75 | | | | | 65 | | |
| $K_2[Sn(OH)_6]$ | | 90 | | | 70 | | | |
| $SnCl_4.5H_2O$ | | | 35 | | | | 35 | |
| (Sn) | 33 | 36 | 14 | 21 | 28 | 29 | 14 | 22 |
| $CoCl_2.6H_2O$ | | 20 | 12 | | | | | |
| $CoSO_4.7H_2O$ | 16 | | | 20 | | | | |
| (Co) | 3 | 5 | 3 | 4 | | | | 25 |
| $NiCl_2.6H_2O$ | | | | | 30 | | | |
| $NiSO_4.6H_2O$ | | | | | | 30 | 42 | |
| (Ni) | | | | | 7 | 7 | 9 | 6 |
| Other component | | | | | | | | |
| $C_6H_8O_7.H_2O$ | | | 50 | 75 | | | 50 | 50 |
| $(NH_4)_3C_6H_5O_7.H_2O$ | | | 40 | 55 | | | | |
| $K_3C_6H_5O_7.H_2O$ | | | | | | | 60 | 60 |
| $HOCH_2CO_2H$ | | | | | 40 | 40 | | |
| $C_{10}H_{14}O_8N_2Na_2.2H_2O$ | 50 | 55 | | | 30 | 25 | | |
| $C_2H_3O_7P_3Na_4$ | 105 | 110 | | | | | | |
| KCl | | | 90 | | 20 | | | |
| KOH | 50 | | | | 35 | | 20 | |
| NaOH | | 65 | | | | 42 | | |
| $K_2SO_4$ | | | | 30 | | | | 19 |
| NaCl | | | | | | 57 | | |

TABLE 5

| | Composition (g/l) | Comparative Experiment No. 9 | 10 | 11 |
|---|---|---|---|---|
| (a) component | $SnCl_5.5H_2O$ | 60 | | 50 |
| | $SnSO_4.2H_2O$ | | 70 | |
| | (Sn) | 20 | 24 | 17 |
| | $Pb(CH_3COO)_2.3H_2O$ | 18 | | |
| | $Pb(ClO_4)_2$ | | 27 | |
| | $Pb(NO_3)_2$ | | | 19 |
| | (Pb) | 11 | 18 | 12 |
| Other component | $K_3C_6H_5O_7.H_2O$ | 125 | | |
| | PEG (polymerization degree 2,000) | | | 7 |
| | $C_{10}H_{14}O_8N_2Na_2.2H_2O$ | 46 | | 45 |
| | Geratin | 5 | 1 | |
| | $CH_3COOK$ | 100 | 100 | 100 |

The electroplating bath composition of the present invention contains 1-hydroxyethane-1,1-diphosphoric acid or salt thereof and methanesulfonic acid or an alkali salt thereof as mixed and the coating produced by the electroplating using the composition bath is stable and excellent in gloss. Owing to the use of a stannic salt as the tan compound as one of the two components of the coating-forming agent, the plating operation proceeds without formation of any precipitation due to such a rapid oxidation reaction as $Sn^{2+} - Sn^{4+} + 2e$ which would occur if a stannous acid were used, the plating bath has a stable tin concentration, and the plating operation can be effectively carried out stably at a pH value selected within a wide range from acidic bath to alkaline bath.

What is claimed is:

1. A method for the production of a tin-cobalt, tin-nickel, or tin-lead binary alloy electroplating bath composition, characterized by mixing a tin salt and one member selected from the group consisting of a cobalt salt, a nickel salt, and a lead salt as an alloy coating-forming agent; at least one member selected from the group consisting of 1-hydroxyethane-1,1diphosphoric acid and salt thereof; at least one member selected from the group consisting of methanesulfonic acid and an alkali salt thereof; and at least one electroconductive salt.

2. The method according to claim 1, wherein said tin salt is contained in said composition in an amount in the range of 5 to 50 g as tin metal per liter of the composition.

3. The method according to claim 1, wherein said cobalt salt is contained in said composition in an amount in the range of 3 to 12 g as cobalt metal per liter of the composition.

4. The method according to claim 1, wherein said nickel salt is contained in said composition in an amount in the range of 3 to 13 g as nickel metal per liter of the composition.

5. The method according to claim 1, wherein said lead salt is contained in said composition in an amount

TABLE 6

| | Comparative Experiment No. 1 | 2 | 3 | 4 | 5 | 6 | 7 | 8 | 9 | 10 | 11 |
|---|---|---|---|---|---|---|---|---|---|---|---|
| pH | 12~13 | 12~13 | 3~4 | 3~4 | 12~13 | 12~13 | 3~4 | 3~4 | 3~4 | 2~3 | 1.5~2.5 |
| Currnet density at cathode, $A/dm^2$ | 0.5~2.0 | 0.5~2.0 | 1~4 | 1~4 | 0.5~2.0 | 0.5~2.0 | 1~4 | 1~4 | 1~5 | 1~5 | 1~5 |
| Current density at anode, $A/dm^2$ | 0.5~1.0 | 0.5~1.0 | 0.5~2.0 | 0.5~2.0 | 0.5~1.0 | 0.5~1.0 | 0.5~2.0 | 0.5~2.0 | 0.5~2.5 | 0.5~2.5 | 1.0~2.5 |
| Bath temperature (°C.) | 55~65 | 55~65 | 35~40 | 35~40 | 60~65 | 60~65 | 35~40 | 35~40 | 50~60 | 50~60 | 50~60 |
| Anode | carbon | 18-8 stainless steel | carbon | ferrite | 18-8 stainless steel | carbon | carbon | carbon | carbon | carbon | ferrite |
| Stirring | airation | airation | airation | airation | airation | airation | airation | airation | airation | airation | airation |
| Undercoating | nickel | nickel | nickel | nickel | nickel | nickel | nickel | nickel | copper | copper | copper |
| Tin content in deposited coating (% by weight) | 78.9 | 79.2 | 80.4 | 79.8 | 68.9 | 70.0 | 67.4 | 70.3 | 38.1 | 16.8 | 32.2 |
| Resistance to nitric acid | ○ | ○ | Δ | ○ | ○ | Δ | Δ | Δ | x | x | x |
| Resistance to hydrochloric acid | x | x | x | x | ○ | ○ | ○ | ○ | ○ | ○ | ○ |
| Resistance to alkali etchant | Δ | Δ | ○ | Δ | Δ | x | Δ | x | ○ | x | ○ |
| Adhesiveness | ○ | ○ | Δ | ○ | ○ | | ○ | ○ | ○ | ○ | ○ |
| Gloss | ○ | ○ | ○ | ⊗ | ○ | ⊗ | ○ | ○ | ⊗ | ⊗ | ⊗ |

in the range of 3 to 25 g as lead metal per liter of the composition.

6. The method according to claim 1, wherein said 1-hydroxyethane-1,1-diphosphoric acid and/or salt thereof is contained in said composition in an amount in the range of 80 to 140 g/liter of said composition.

7. The method, according to claim 1, wherein said methane-sulfonic acid and/or salt thereof is contained in said bath composition in an amount in the range of 1 to 4 mol per mol of said 1-hydroxyethane-1,1-diphosphoric acid and/or salt thereof.

8. The method according to claim 1, wherein said tin salt is a compound of tetravalent tin.

9. A tin-cobalt, tin-nickel, or tin-lead binary alloy electroplating bath composition containing as substantially main components thereof a tin salt and one member selected from the group consisting of a cobalt salt, a nickel salt, and a lead salt as an alloy coating-forming agent; at least one member selected from the group consisting of 1-hydroxyethane-1,1-diphosphoric acid and salt thereof; at least one member selected from the group consisting of methanesulfonic acid and an alkali salt thereof; and an electroconductive salt.

10. The bath composition according to claim 9, wherein said tin salt concentration is in the range of 5 to 50 g as tin metal per liter of said bath composition.

11. The bath composition according to claim 9, wherein said cobalt salt concentration is in the range of 3 to 12 g as cobalt metal per liter of said bath composition.

12. The bath composition according to claim 9, wherein said nickel salt concentration is in the range of 3 to 13 g as nickel metal per liter of said bath composition.

13. The bath composition according to claim 9, wherein said lead salt concentration is in the range of 3 to 25 g as lead metal per liter of said bath composition.

14. The bath composition according to claim 9, wherein the concentration of said 1-hydroxyethane-1,1-diphosphoric acid and/or salt thereof is in the range of 80 to 140 g per liter of the composition.

15. The bath composition according to claim 9, wherein the concentration of said methanesulfonic acid and/or alkali salt thereof is in the range of 1 to 4 mols per mol of said 1-hydroxyethane-1,1-diphosphoric acid and/or salt thereof.

16. The bath composition according to claim 9, wherein said tin salt is a compound of tetravalent tin.

* * * * *